US009085144B2

(12) United States Patent
Nakagawa et al.

(10) Patent No.: US 9,085,144 B2
(45) Date of Patent: Jul. 21, 2015

(54) LIQUID EJECTION HEAD AND INKJET PRINTING APPARATUS

(71) Applicant: CANON KABUSHIKI KAISHA, Tokyo (JP)

(72) Inventors: Yoshiyuki Nakagawa, Kawasaki (JP); Takatsuna Aoki, Yokohama (JP); Kazuhiro Yamada, Yokohama (JP); Yumi Komamiya, Kawasaki (JP); Ryo Kasai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/259,535

(22) Filed: Apr. 23, 2014

(65) Prior Publication Data

US 2014/0327721 A1 Nov. 6, 2014

(30) Foreign Application Priority Data

May 2, 2013 (JP) ..... 2013-097068
Apr. 9, 2014 (JP) ..... 2014-080381

(51) Int. Cl.
*B41J 2/05* (2006.01)
*B41J 2/14* (2006.01)

(52) U.S. Cl.
CPC ..... *B41J 2/14145* (2013.01); *B41J 2/1404* (2013.01); *B41J 2/14129* (2013.01)

(58) Field of Classification Search
CPC .. B41J 2/14427; B41J 2/1601; B41J 2/14129; B41J 2/14145; B41J 2/145
USPC ..... 347/54, 56, 65
See application file for complete search history.

(56) References Cited

U.S. PATENT DOCUMENTS

| | | | | |
|---|---|---|---|---|
| 6,257,706 | B1 * | 7/2001 | Ahn | 347/54 |
| 7,377,624 | B2 | 5/2008 | Park et al. | |
| 8,573,749 | B2 * | 11/2013 | Pan et al. | 347/65 |
| 8,662,642 | B2 | 3/2014 | Komamiya et al. | |
| 2010/0283819 | A1 | 11/2010 | Tamaru et al. | |

FOREIGN PATENT DOCUMENTS

JP 2006-007780 A 1/2006

* cited by examiner

*Primary Examiner* — An Do
(74) *Attorney, Agent, or Firm* — Fitzpatrick, Cella, Harper & Scinto

(57) ABSTRACT

A liquid ejection head capable of more efficiently ejecting ink and an inkjet printing apparatus are provided. The liquid ejection head has a block member which surrounds at least a part of an effective bubble-generating region involved with heat generation in a heat-generating element and which is formed so as to protrude from the heat-generating element in a direction in which a liquid is ejected. The block member is arranged in a position where a distance of a position of an inner end part from an outer end part of the effective bubble-generating region is +2 μm or less, with an outward direction being set to be positive.

13 Claims, 8 Drawing Sheets

LIQUID EJECTION HEAD AND INKJET PRINTING APPARATUS

BACKGROUND OF THE INVENTION

1. Field of the Invention

The present invention relates to a liquid ejection head configured to heat a liquid by a heat-generating element and to eject the liquid through an ejection port, and an inkjet printing apparatus.

2. Description of the Related Art

The inkjet printing apparatus includes a thermal inkjet system in which ink is heated by driving a heat-generating element arranged inside a liquid ejection head and bubbles are generated within the ink, thereby ink droplets being ejected through an ejection port.

In the liquid ejection head in the inkjet printing apparatus of thermal inkjet system, in the case where bubbles are generated by driving the heat-generating element in order to eject ink droplets, a backflow of ink may be caused inside the ink flow passage of the liquid ejection head due to generation of bubbles. In the case where the backflow of ink is caused, the pressure increased by generation of bubbles is reduced inside the ink flow passage and there is a possibility that the efficiency in ejection of ink droplets is lowered. Therefore, there is a possibility that power required for driving the heat-generating element is increased and energy consumption is increased.

The liquid ejection head in which blocks are arranged around the heat-generating element in order to suppress such a backflow is disclosed in Japanese Patent Laid-Open No. 2006-007780. Since blocks are arranged around the heat-generating element, the backflow of ink caused by generation of bubbles in ejection of ink is suppressed to be small. Therefore, in driving the heat-generating element, kinetic energy is efficiently given to stored ink and it is possible to eject ink droplets efficiently and to reduce the consumption amount of energy.

However, in Japanese Patent Laid-Open No. 2006-007780, the position of the block arranged around the heat-generating element in the liquid ejection head is not specified. Therefore, depending on the position of the block arranged around the heat-generating element, there is a possibility that bubbles generated by driving the heat-generating element are not used efficiently for ejection of ink. Due to this, there is a possibility that it is necessary to generate a larger amount of heat by the heat-generating element in order to eject ink, and thus the amount of power consumption increases and the running cost rises. Furthermore, the size of the heat-generating element used for ejection of ink is increased, and thus there is a possibility that the liquid ejection head becomes large and at the same time, the manufacturing cost of the liquid ejection head rises.

SUMMARY OF THE INVENTION

Therefore, in view of the above-described circumstances, an object of the present invention is to provide a liquid ejection head capable of ejecting ink more efficiently and an inkjet printing apparatus.

According to the present invention, a liquid ejection head comprises a liquid chamber capable of storing liquid therein; a heat-generating element capable of heating a liquid inside the liquid chamber; and an ejection port through which a liquid is ejected by generation of bubbles in a case of generating the bubbles within the liquid by heat generation of the heat-generating element in a state where the liquid is stored in the liquid chamber, wherein the liquid ejection head has a block member which surrounds at least a part of an effective bubble-generating region involved with heat generation in the heat-generating element and which is formed so as to protrude from the heat-generating element in a direction in which a liquid is ejected, and the block member is arranged in a position where a distance of a position of an inner end part of the block member from an outer end part of the effective bubble-generating region is +2 μm or less, with an outward direction being set to be positive.

According to the present invention, a liquid ejection head comprises a liquid chamber capable of storing a liquid therein; a heat-generating element capable of heating a liquid inside the liquid chamber; and an ejection port through which a liquid is ejected by generation of bubbles in a case of generating the bubbles within the liquid by heat generation of the heat-generating element in a state where the liquid is stored in the liquid chamber, wherein the liquid ejection head has a block member which surrounds at least a part of an effective bubble-generating region involved with heat generation in the heat-generating element and which is formed so as to protrude from the heat-generating element in a direction in which a liquid is ejected, and the block member is arranged in a position where a period of time during which a pressure inside a bubble generated by driving the heat-generating element is higher than the atmospheric pressure is lengthened in comparison with that in a case where the block member is not provided in driving the heat-generating element.

According to the present invention, a liquid ejection head comprises a liquid chamber capable of storing a liquid therein; a heat-generating element capable of heating a liquid inside the liquid chamber; and an ejection port through which a liquid is ejected by generation of bubbles in a case of generating the bubbles within the liquid by heat generation of the heat-generating element in a state where the liquid is stored in the liquid chamber, wherein the liquid ejection head has a block member which surrounds at least a part of an effective bubble-generating region involved with heat generation in the heat-generating element and which is formed so as to protrude from the heat-generating element in a direction in which a liquid is ejected, and the block member is arranged in a position where an amount of reduction per unit time in a pressure inside a bubble after driving the heat-generating element is reduced in comparison with that in a case where the block member is not provided.

According to the present invention, an inkjet printing apparatus for performing printing by ejecting a liquid through an ejection port by using a liquid ejection head includes a liquid chamber capable of storing a liquid therein; a heat-generating element capable of heating a liquid inside the liquid chamber; and the ejection port through which a liquid is ejected by generation of bubbles in a case of generating the bubbles within the liquid by heat generation of the heat-generating element in a state where the liquid is stored in the liquid chamber, wherein a block member is provided, which surrounds at least a part of an effective bubble-generating region involved with heat generation in the heat-generating element and which is formed so as to protrude from the heat-generating element in a direction in which a liquid is ejected, and the block member is arranged in a position where a distance of a position of an inner end part of the block member from an outer end part of the effective bubble-generating region is +2 μm or less, with an outward direction being set to be positive.

According to the present invention, a liquid ejection head comprises an ejection port through which a liquid is ejected; and a substrate on which a heat-generating element generating energy used for ejecting a liquid is formed, wherein on the substrate, a convex portion is formed around the outer circumference of an effective bubble-generating region of the heat-generating element and an interval between the effective bubble-generating region of the heat-generating element and the convex portion is 2 μm or less.

According to the present invention, a liquid ejection head comprises an ejection port through which a liquid is ejected; and a substrate on which a heat-generating element generating energy used for ejecting a liquid is formed, wherein on the substrate, a convex portion surrounding a centroid of the heat-generating element is formed on an effective bubble-generating region of the heat-generating element and an interval between an outer end part of the effective bubble-generating region of the heat-generating element and the convex portion is 3 μm or less.

According to the present invention, it is possible to efficiently eject ink with a small amount of energy consumption, and thus it is possible to suppress power consumption to be small. Because of this, it is possible to provide a liquid ejection head, the running cost of which is reduced. Furthermore, it is possible to efficiently use energy consumed by a heat-generating element for ejection of ink, and thus the heat-generating element can be downsized. Consequently, it is possible to provide a downsized liquid ejection head and at the same time, to reduce the manufacturing cost of the liquid ejection head. In addition, it is possible to provide an inkjet printing apparatus, the running cost of which is suppressed to be low.

Further features of the present invention will become apparent from the following description of exemplary embodiments (with reference to the attached drawings).

DESCRIPTION OF THE EMBODIMENTS

Hereinafter, an inkjet printing apparatus and a liquid ejection head according to an embodiment of the present invention will be explained with reference to the drawings.

Figure 1:
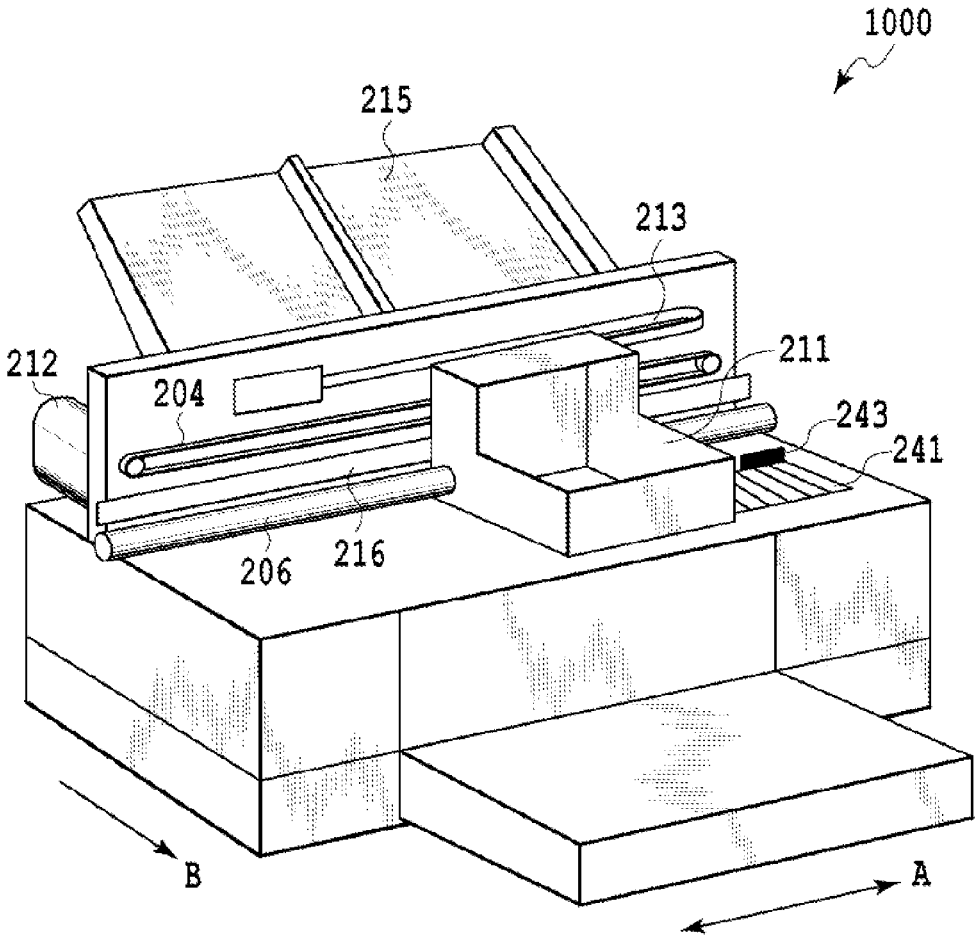
FIG. 1 is a perspective view showing an inkjet printing apparatus according to an embodiment of the present invention.

FIG. 1 is a perspective view of an inkjet printing apparatus 1000 according to the embodiment of the present invention. The inkjet printing apparatus 1000 shown in FIG. 1 includes a carriage 211 in which a liquid ejection head unit 410 as an inkjet liquid ejection head is mounted. In the inkjet printing apparatus 1000 of the present embodiment, the carriage 211 is guided so as to be capable of moving in the main scanning direction of an arrow A along a guide shaft 206. The guide shaft 206 is arranged so as to extend along the width direction of a print medium. Consequently, the liquid ejection head mounted in the carriage 211 performs printing while scanning in a direction intersecting a conveyance direction in which the print medium is conveyed. As described above, the inkjet printing apparatus 1000 is a so-called serial-scan-type inkjet printing apparatus that prints an image accompanied by the movement of a liquid ejection head 1 in the main scanning direction and the conveyance of the print medium in the sub-scanning direction.

The carriage 211 is supported by the guide shaft 206 penetrating therethrough so as to be scanned in a direction orthogonal to the conveyance direction of a print medium. A belt 204 is attached to the carriage 211, and a carriage motor 212 is attached to the belt 204. Due to this, a driving force by the carriage motor 212 is transmitted to the carriage 211 via the belt 204, and thus the carriage 211 is configured so as to be capable of moving in the main scanning direction while being guided by the guide shaft 206.

In addition, a flexible cable 213 for transferring an electrical signal from a control unit to be described later, to the liquid ejection head of the liquid ejection head unit is attached to the carriage 211 in a state of being connected to the liquid ejection head unit. Furthermore, in the inkjet printing apparatus 1000, a cap 241 and a wiper blade 243 used for performing recovery processing of the liquid ejection head are arranged. Moreover, the inkjet printing apparatus 1000 has a sheet feed unit 215 that stores print media in a stacked state and an encoder sensor 216 that optically reads the position of the carriage 211.

The carriage 211 is caused to reciprocate in the main scanning direction by the carriage motor and a drive power transmission mechanism such as a belt that transmits the driving force thereof. In the carriage 211, there is mounted a plurality of liquid ejection head units 410 corresponding to the kinds of ink that can be ejected by the inkjet printing apparatus. The print medium is conveyed in the sub scanning direction of an arrow B by a conveyance roller after being stacked on the sheet feed unit 215. The inkjet printing apparatus 1000 sequentially prints images on the print medium by repeating the printing operation to cause the liquid ejection head to eject ink while moving the liquid ejection head in the main scanning direction, and the conveying operation to convey the print medium in the sub scanning direction.

Figure 2A:
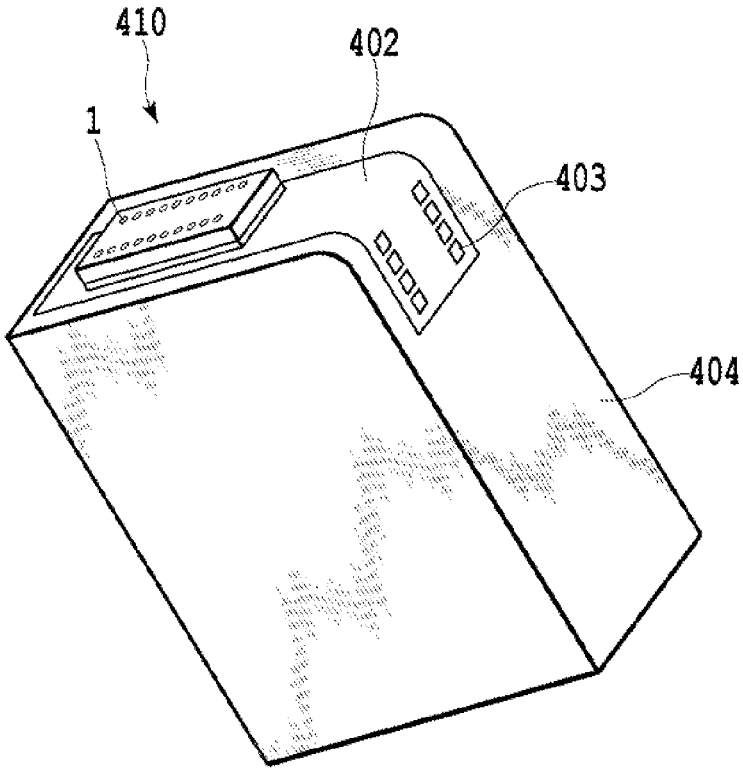
FIG. 2A is a perspective view of a liquid ejection head unit mounted in the inkjet printing apparatus in FIG. 1.

FIG. 2A shows a perspective view of the liquid ejection head unit 410. The liquid ejection head unit 410 is a unit in the form of a cartridge in which a liquid ejection head is integrated with an ink tank. The liquid ejection head unit 410 is configured inside the carriage 211 in an attachable and detachable manner. The liquid ejection head 1 is attached to the liquid ejection head unit 410. A tape member 402 for TAB (Tape Automated Bonding) having a terminal for supplying power is bonded to the liquid ejection head unit 410. Through this tape member 402, power is supplied selectively from the inkjet printing apparatus 1000 to each heat-generating element 12. In supply of power to the heat-generating element 12, power is supplied from a contact 403 to the liquid ejection head 1, through the tape member 402. Furthermore, the liquid ejection head unit 410 includes an ink tank 404 for temporarily storing ink and supplying ink to the liquid ejection head 1 therefrom.

Figure 2B:
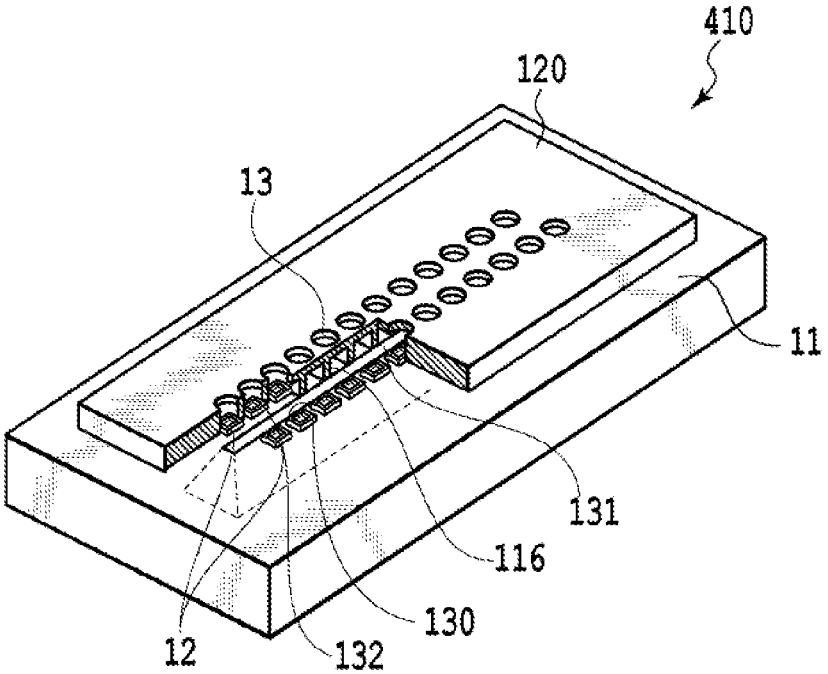
FIG. 2B is a perspective view of a liquid ejection head, a part of which is broken away, attached to the liquid ejection head unit in FIG. 2A.

FIG. 2B shows a perspective view of the liquid ejection head unit 410, a part of which is broken away. The liquid ejection head 1 of the present embodiment is formed by bonding a flow passage-forming member 120 to a liquid ejection head substrate 11 at which the heat-generating element 12 for generating energy applied to eject liquid is formed. Between the flow passage-forming member 120 and the liquid ejection head substrate 11, a plurality of liquid chambers 132 capable of storing ink therein is defined in response to respective ejection ports 13. Inside the liquid chamber 132, in the position corresponding to each ejection port 13, the heat-generating element 12 capable of heating ink inside the liquid chamber is formed. In a region inside the heat-generating element 12, an effective bubble-generating region 16 is formed. The effective bubble-generating region 16 refers to a portion of the heat-generating element 12, which generates heat by application of power thereto and is involved with generation of bubbles.

In the liquid ejection head substrate 11, an ink supply port 130 is formed so as to penetrate through the liquid ejection head substrate 11. In the flow passage-forming member 120, a common liquid chamber 131 is formed so as to be communicated with the ink supply port 130. Furthermore, in the flow passage-forming member 120, an ink flow passage 116 is formed so as to extend from the common liquid chamber 131 to each liquid chamber 132. Consequently, the flow passage-forming member 120 is formed so that the common liquid chamber 131 and each liquid chamber 132 are communicated with each other via the ink flow passage 116. In the position corresponding to the heat-generating element 12 in the flow passage-forming member 120, the ejection port 13 is formed.

Figure 3A:
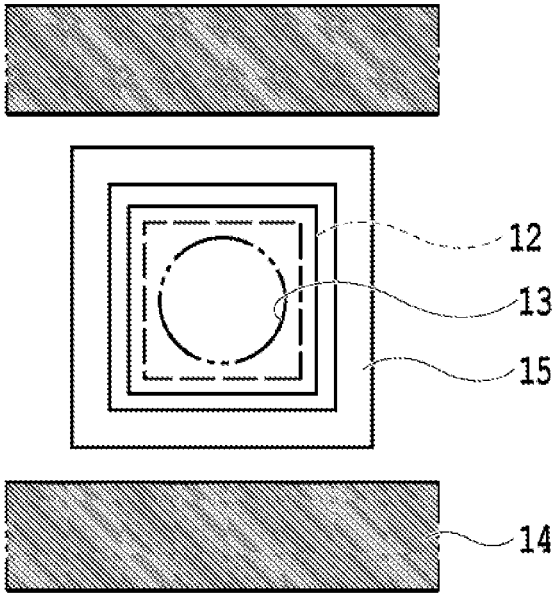
FIG. 3A is a schematic cross-sectional view in the case where essential parts in the liquid ejection head in FIG. 2B are viewed along a direction in which droplets are ejected.
Figure 3B:
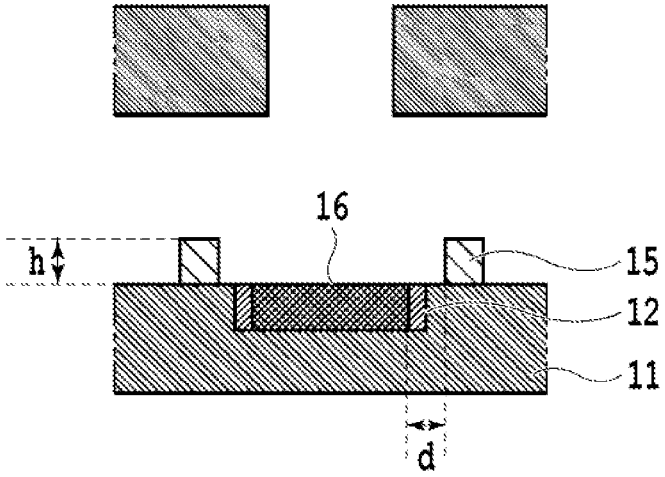
FIG. 3B is a schematic cross-sectional view in the case where the essential parts in the liquid ejection head are viewed from the side.

FIG. 3A shows a schematic cross-sectional view in the case where the periphery of the ejection port 13 and the heat-generating element 12 in the liquid ejection head 1 is viewed along the direction in which droplets are ejected and FIG. 3B shows a schematic cross-sectional view in the case where the periphery of the ejection port 13 and the heat-generating element 12 are viewed from the side of the liquid ejection head 1. In a region sandwiched by flow passage walls 14, the heat-generating element 12 is arranged. As shown in FIGS. 3A and 3B, around the heat-generating element 12, there is provided a block member 15 which is convex portion protruding toward the direction in which droplets are ejected from the surface on which the heat-generating element 12 is formed. The block member 15 is arranged outside the heat-generating element 12 so as to surround at least the periphery of centroid of the heat-generating element 12.

Furthermore, as shown in FIG. 3B, the length between the outer end part of the effective bubble-generating region 16 formed inside the heat-generating element 12 and the inner end part of the block member 15 is set to d. Here, the effective bubble-generating region 16 is surrounded across the entire block member 15. The length d between the outer end part of the effective bubble-generating region 16 and the inner end part of the block member 15 is formed so as to be equal across the entire block member 15. In addition, the length along the liquid ejection direction in the block member 15 is set to be h. In the present embodiment, as will be described later, the block member 15 is arranged so that the length d from the outer end part of the effective bubble-generating region 16 to the inner end part of the block member 15 is +2 μm or less, with the outward direction being set to be positive.

In supply of ink from the ink tank 404 to the liquid ejection head 1, ink is supplied to the common liquid chamber 131 through the ink supply port 130 in the liquid ejection head substrate 11. The ink supplied to the common liquid chamber 131 is supplied to the inside of each liquid chamber 132 through the ink flow passage 116. At this time, the ink within the common liquid chamber 131 is supplied to the ink flow passage 116 and the liquid chamber 132 by the capillary phenomenon and by forming a meniscus at the ejection port 13, the liquid surface of the ink is held stable.

Figure 4:
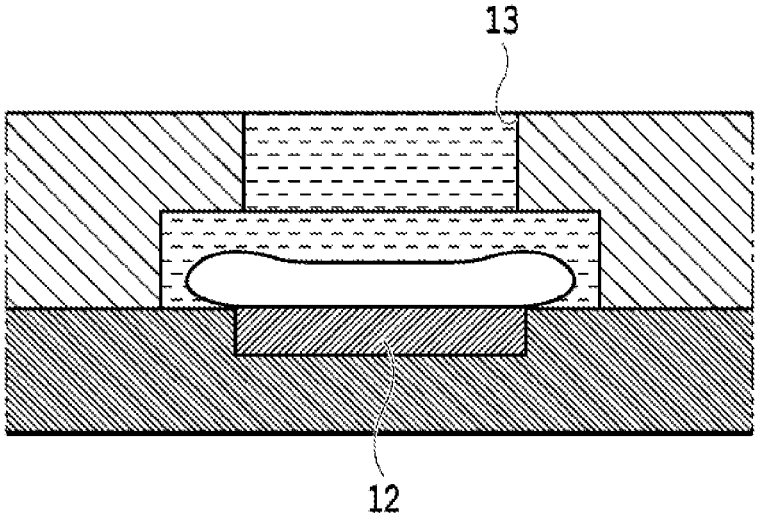
FIG. 4 is a cross-sectional view of the liquid ejection head showing a heat-generating element and bubbles in ejection of ink by the liquid ejection head in FIG. 2B.

In ejection of ink as a liquid from the liquid ejection head 1, the heat-generating element 12 is energized through a wire in a state where the inside of the liquid chamber 132 is filled with the liquid. FIG. 4 shows a cross-sectional view of the liquid ejection head at this time. By energizing the heat-generating element 12, thermal energy is generated in the heat-generating element 12. Due to this, the liquid around the heat-generating element 12 within the liquid chamber 132 is heated and bubbles are generated within the liquid by film boiling. In this way, in a case of generation of bubbles within the liquid, the liquid is ejected through the ejection port 13 by the foaming energy at that time.

Figure 5A:
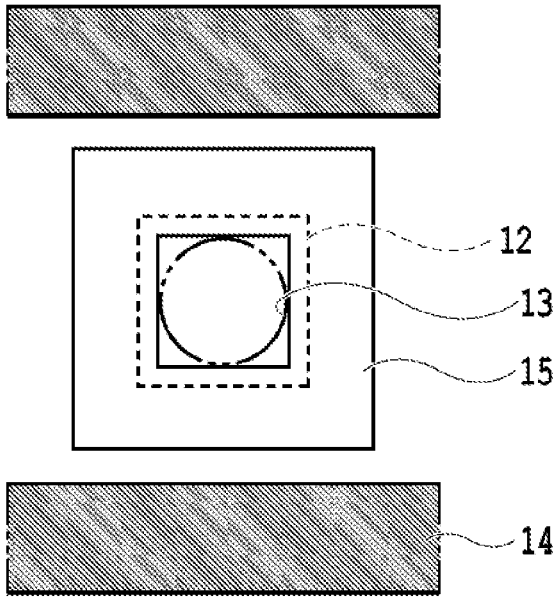
FIG. 5A is a schematic cross-sectional view of the liquid ejection head in FIG. 2B viewed along the direction in which droplets are ejected in the case where an inner end part of a block member coincides with an outer end part of an effective bubble-generating region in the heat-generating element.
Figure 5B:
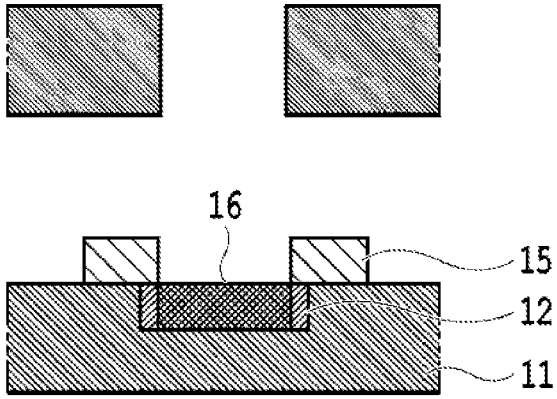
FIG. 5B is a schematic cross-sectional view, viewed from the side.

It is not necessary to arrange the block member 15 so that the inner end part thereof is located outside the effective bubble-generating region 16. As shown in FIGS. 5A and 5B, the block member 15 may be arranged so that the inner end part coincides with the outer end part of the effective bubble-generating region 16. Furthermore, the block member 15 may be arranged so that the inner end part is located inside the effective bubble-generating region 16. In the present embodiment, it suffices that the block member 15 has only to be arranged so as to surround at least a part of the effective bubble-generating region 16 involved with heat generation in the heat-generating element 12.

Furthermore, explanation has been given with the aspect in which the block member 15 in the present embodiment surrounds the periphery of the effective bubble-generating region 16 continuously. However, the present invention is not limited to this and can be applied also to an aspect in which the block member surrounds the effective bubble-generating region discontinuously. In a liquid ejection head in which flow passages extend in two directions for the heat-generating element shown in FIG. 5, it is preferable to provide the block member at least across the entire region on the flow passage side with respect to the heat-generating element. Moreover, an aspect is preferable in which the region of 75% or more of the periphery of the heat-generating element is surrounded as a whole by partially providing a wall also in the direction of the flow passage wall 14 with respect to the heat-generating element.

Hereinafter, in the present embodiment, ejection of ink from each liquid ejection head in a case of changing the position of the block member 15 will be explained.

Figure 6:
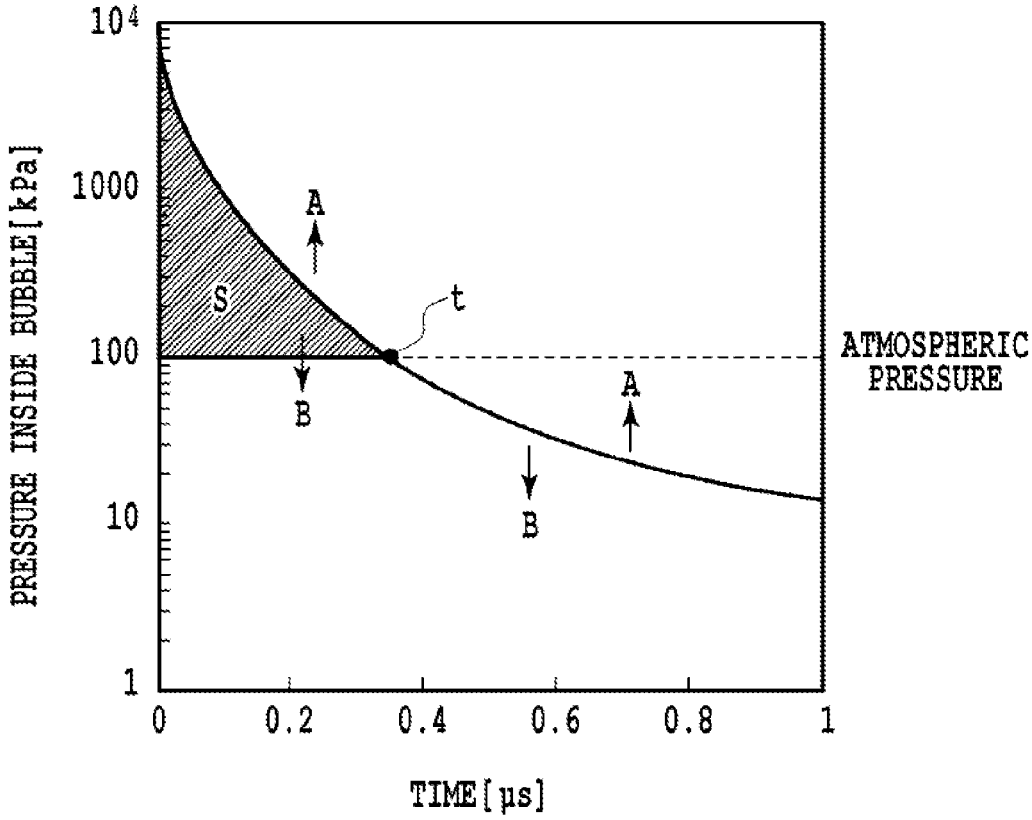
FIG. 6 is a graph showing a relationship between a pressure inside a bubble and an elapsed time after the bubble is generated in ejection of ink by the liquid ejection head in FIG. 2B.

FIG. 6 shows a graph showing a relationship between the pressure inside the bubble and the elapsed time, after the bubble is generated. After the bubble is generated, the pressure inside the bubble is higher than the atmospheric pressure for a fixed period of time, and during the period of time, the bubble enlarges and expands. In the case where the bubble is generated having a fixed pressure, the pressure inside the bubble is gradually reduced and after the pressure inside the bubble becomes lower than the atmospheric pressure, the bubble is pressed by the surroundings and the size of the bubble is reduced. That is, during the period of time during which the pressure inside the bubble is higher than the atmospheric pressure, the bubble expands and at the same time, the liquid is pushed out of the ejection port thus droplets are ejected, by the pressure inside the bubble. Then, after the pressure inside the bubble becomes lower than the atmospheric pressure, the bubble is pushed inwardly by the liquid, and thus the size of the bubble is reduced. Here, in about 0.35 μs after the bubble is generated, the pressure inside the bubble becomes lower than the atmospheric pressure. The time elapsed after generation of the bubble is set to be t, in the case where the pressure inside the bubble becomes equal to the atmospheric pressure, and is shown in the graph in FIG. 6. In the time interval from 0 μs to t μs after generation of the bubble (up to about 0.35 μs), the pressure inside the bubble is higher than the atmospheric pressure, and thus the bubble expands and in the time interval of t μs and thereafter, the pressure inside the bubble is lower than the atmospheric pressure, and thus the size of the bubble is reduced.

In the present embodiment, the block member 15 is arranged outside the heat-generating element 12 so as to surround the periphery of the heat-generating element 12, and thus it is possible to suppress the backflow of ink toward the ink supply port 130 in generation of bubbles. Consequently, it is possible to suppress wasteful consumption of a part of thermal energy generated in the heat-generating element 12 by ink flowing back in the direction toward the ink supply port 130 in generation of bubbles. In the case where there is caused the backflow of ink toward the ink supply port 130, the pressure inside the bubble is reduced rapidly. In such a case, the slope of the curve of the graph shown in FIG. 6 shifts in the direction indicated by an arrow B, and thus an area S of the area where the pressure inside the bubble is higher than the atmospheric pressure is reduced by an amount corresponding to the shift. Therefore, it is not possible to efficiently use the thermal energy for ejection of ink and a large amount of energy is required to eject ink, and thus there is a possibility that the amount of energy consumption is increased.

The slope of the graph shown in FIG. 6 changes depending on the length d between the outer end part of the effective bubble-generating region 16 in the heat-generating element 12 and the inner end part of the block member 15, with the outward direction being set to be positive. On the other hand, in the case where the heat-generating element 12 that is used and the power applied to the heat-generating element 12 remain unchanged, the amount of heat generated by the heat-generating element 12 in a case of applying power to the heat-generating element 12 remains unchanged. Therefore, in case that the length d between the outer end part of the effective bubble-generating region 16 in the heat-generating element 12 and the inner end part of the block member 15 is changed, the initial value of the pressure inside the bubble at a time of 0 μs remains unchanged.

In accordance with the length d between the effective bubble-generating region 16 and the block member 15, the slope of the graph in FIG. 6 showing the pressure inside the bubble changes. Consequently, the time at which the pressure inside the bubble shifts from the area where the pressure inside the bubble is equal to or higher than the atmospheric pressure, to the area where the pressure inside the bubble is lower than the atmospheric pressure changes depending on the length d between the effective bubble-generating region 16 and the block member 15. In the case where the length d between the effective bubble-generating region 16 and the block member 15 is 0 or more, the longer the length d is, the larger the amount of reduction in the pressure inside the bubble becomes. Therefore, the negative slope (amount of reduction in pressure per unit time) of the graph shown in FIG. 6 becomes larger and the time t at which the pressure inside the bubble changes from the area where the pressure inside the bubble is equal to or higher than the atmospheric pressure, to the area where the pressure inside the bubble is equal to or less than the atmospheric pressure is advanced. That is, in the graph shown in FIG. 6, with the initial value at the time 0 being kept at a fixed value, the curve moves in the direction of the arrow B. On the other hand, the shorter the length d is, the smaller the amount of reduction in the pressure inside the bubble becomes. Therefore, the negative slope (amount of reduction in pressure per unit time) of the graph shown in FIG. 6 becomes smaller and the time t at which the pressure inside the bubble changes from the area where the pressure inside the bubble is equal to or higher than the atmospheric pressure, to the area where the pressure inside the bubble is equal to or less than the atmospheric pressure is delayed. That is, in the graph shown in FIG. 6, the curve moves in the direction of an arrow A, with the initial value at the time 0 being kept at a fixed value.

As described above, by the change of the length d between the effective bubble-generating region 16 and the block member 15, the time t changes at which the pressure inside the bubble changes from the area where the pressure inside the bubble is equal to or higher than the atmospheric pressure, to the area where the pressure inside the bubble is equal to or lower than the atmospheric pressure. In the present embodiment, the block member 15 is arranged in the position where there is increased the period of time during which the pressure inside the bubble generated by driving the heat-generating element 12 is higher than the atmospheric pressure, in comparison with the case where the block member 15 is not provided in driving the heat-generating element 12.

In ejection of ink, ink is ejected through the ejection port 13 by the energy of the bubble having the pressure equal to or higher than the atmospheric pressure. Therefore, in the graph of pressure inside the bubble shown in FIG. 6, the larger the area S of the area where the pressure is equal to or higher than the atmospheric pressure, the more energy can be given to ink. In the present embodiment, by reduction of the length d between the effective bubble-generating region 16 and the block member 15, it is possible to reduce the amount of reduction per unit time in the pressure inside the bubble after driving the heat-generating element 12. Due to this, it is possible to move the curve of the graph shown in FIG. 6 in the direction of the arrow A. As a result, it is possible to increase the area S of the area where the pressure is equal to or higher than the atmospheric pressure of the graph in FIG. 6. As described above, in the present embodiment, the block member 15 is arranged in the position where the amount of reduction per unit time in the pressure inside the bubble after driving the heat-generating element 12 is reduced in comparison with the case where the block member 15 is not provided.

Furthermore, in the case where the block member 15 is arranged so that the inner end part of the block member 15 is located inside the effective bubble-generating region 16, ink is heated only in the region inside the block member 15 in the heat-generating element 12. Therefore, in this case, even by applying power to the heat-generating element 12, all the thermal energy generated by the heat-generating element 12 is not necessarily used for ejection of ink. The larger the volume of the block member 15 arranged inside the effective bubble-generating region 16, the smaller the area of the region where ink is heated by the heat-generating element 12 becomes. Therefore, the amount of energy used for ejection of ink becomes smaller and the area S shown in the graph in FIG. 6 becomes smaller. Accordingly, the larger the volume of the block member 15 entering inside the effective bubble-generating region 16, the lower the efficiency of ink ejection becomes. On the other hand, the smaller the volume of the block member 15 entering inside the effective bubble-generating region 16, the more the efficiency of ink ejection can be improved.

Figure 7:
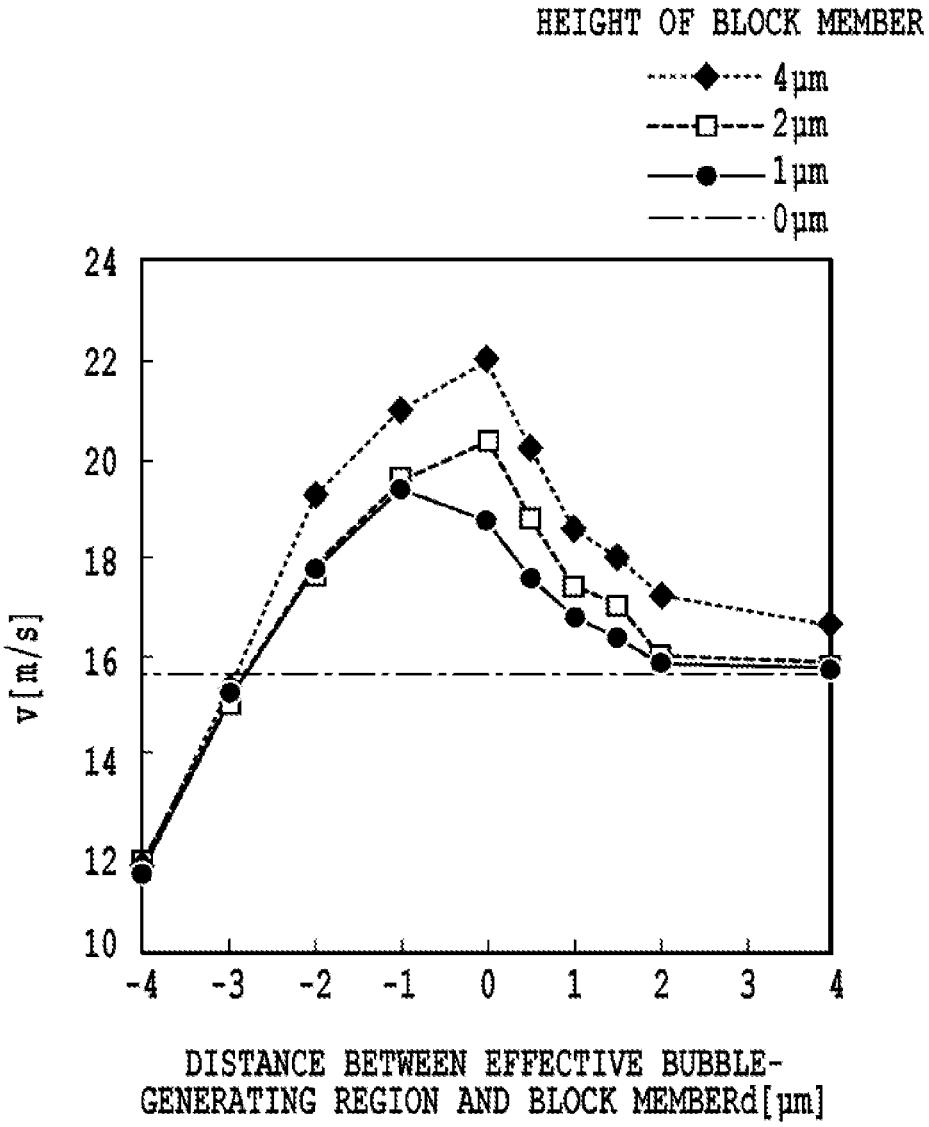
FIG. 7 is a graph showing a relationship between the distance between the outer end part of the effective bubble-generating region and the inner end part of the block member, and the velocity of ejected ink in the case where ink is ejected by the liquid ejection head in FIG. 2B while changing the position of the block member.

FIG. 7 shows a graph in which the horizontal axis represents the distance d (μm) between the outer end part of the effective bubble-generating region 16 and the inner end part of the block member 15 and the vertical axis represents a velocity v (m/s) of ejected ink. The graph in FIG. 7 is a graph showing the velocity of ejected ink in the case where the same power is applied to the same heat-generating element and the position of the block member 15 is changed. The graph in FIG. 7 shows the velocity of ink at the time of ink ejection in the case where the block member 15 is arranged so that the distance from the effective bubble-generating region 16 is equal across the entire inner end part of the block member 15. That is, in the position where the distance d between the effective bubble-generating region 16 and the block member 15 is 0, the block member 15 is arranged so that the inner end part coincides with the outer end part of the effective bubble-generating region 16 across the entire block member 15. Furthermore, in the position where the distance d is a value other than 0, the block member 15 is arranged so that the distance between the inner end part of the block member 15 and the outer end part of the effective bubble-generating region 16 is equal to d across the entire inner end part of the block member 15. As shown in FIG. 7, in the position where the distance d between the outer end part of the effective bubble-generating region 16 and the inner end part of the block member 15 is 0 μm or −1 μm, the velocity of ejected ink reaches its peak. As the position of the block member 15 becomes more distant from the position of the peak in the outward direction, the velocity of ejected ink becomes lower. In addition, similarly, in the position where the inner end part of the block member 15 is located inside the outer end part of the effective bubble-generating region 16, as the position of the block member 15 moves in the inward direction, the velocity of ejected ink becomes lower.

Furthermore, FIG. 7 shows velocities of ejected ink in the case where the block member 15 has different heights, respectively. Here, it is assumed that the height of the block member 15 refers to the distance from the heating surface of the heat-generating element 12 to the outermost end part in the ejection direction in which ink is ejected in the block member 15. As shown in FIG. 7, in the range up to 4 μm of the height of the block member 15, the greater the height of the block member 15, the higher the velocity of ejected ink is. Meanwhile, although not shown in FIG. 7, it has been known that, in the range in which the height of the block member 15 is greater than 4 μm, the velocity of ejected ink does not change so much in comparison with that in the case where the height is 4 μm even by increasing the height. Therefore, it is preferable to set the height of the block member 15 to 4 μm or less. It is difficult to enhance efficiency in ink ejection even by increasing the height of the block member 15 greater than 4 μm. In addition, in the case where the block member 15 is formed so that the height thereof is 4 μm or more, there is a possibility that the size of the liquid ejection head is increased while ejection efficiency is not increased. Furthermore, there is a possibility that the manufacturing cost of the liquid ejection head is increased because the size of the liquid ejection head is increased. Therefore, it is desirable to set the height of the block member 15 to 4 μm or less. By setting the height of the block member 15 to less than or equal to 4 μm, it is possible to downsize the liquid ejection head and also possible to suppress the manufacturing cost of the liquid ejection head to be low.

Figure 8:
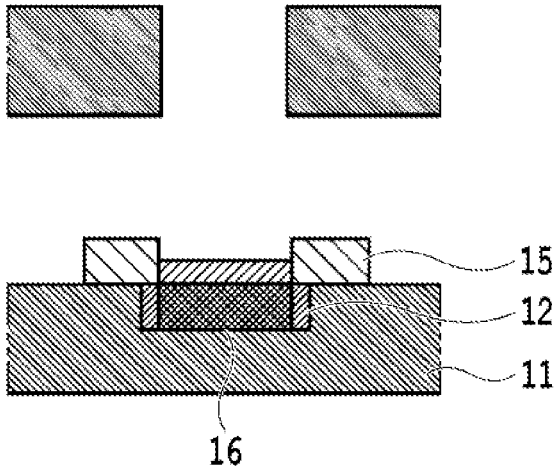
FIG. 8 is a cross-sectional view showing the essential parts of the liquid ejection head in generating bubbles by driving the heat-generating element in the liquid ejection head in FIG. 2B in the case where the inner end part of the block member coincides with the outer end part of the effective bubble-generating region.

From the graph shown in FIG. 7, in the case where the inner end part of the block member 15 is located outside the effective bubble-generating region, it is desirable for the block member 15 to be arranged in the position where the distance d between the position of the inner end part and the outer end part of the effective bubble-generating region 16 is 2 μm or less. FIG. 8 shows a cross-sectional view of the periphery of the ejection port and the heat-generating element 12 of the liquid ejection head in the case where the inner end part of the block member 15 coincides with the outer end part of the effective bubble-generating region 16 and where bubbles are generated by driving the heat-generating element 12. As shown in FIG. 8, during the period of time during which the pressure inside the bubble is higher than the atmospheric pressure after the heat-generating element 12 is driven and bubbles are generated, the block member 15 prevents the bubbles from expanding in the direction horizontal to the heating surface and at the same time, prevents the backflow of ink. Due to this, the thermal energy generated in the heat-generating element 12 is used efficiently for ejection of ink. By arranging the block member 15 in this way, in the range in which the pressure inside the bubble is equal to or higher than the atmospheric pressure, it is possible to eject ink while keeping the velocity in ink ejection high in generation of bubbles. That is, the thermal energy generated in the heat-generating element 12 is used efficiently for ejection of ink. Accordingly, it is possible to efficiently eject ink. By arranging the block member 15 in this way, it is possible to eject ink while keeping the power applied to the heat-generating element 12 small. Therefore, it is possible to keep power consumption low in ejection of ink. Due to this, it is possible to suppress the running cost of the inkjet printing apparatus to be low.

Furthermore, from the graph shown in FIG. 7, it is desirable for the block member 15 to be arranged in the position where the distance d between the position of the inner end part of the block member and the outer end part of the effective bubble-generating region 16 is −3 μm or more, with the outward direction being set to be positive. That is, it is desirable that the length in which the position of the inner end part of the block member 15 enters inside the effective bubble-generating region 16 is 3 μm or less. As described previously, in the case where the block member 15 is arranged so that the inner wall surface of the block member 15 is located inside the effective bubble-generating region 16, the larger the volume of the block member 15 arranged inside the effective bubble-generating region 16, the lower the efficiency of ink ejection becomes. However, in the case where the block member 15 is in the range from the position where the block member 15 coincides with the outer end part of the effective bubble-generating region 16, to the position where the distance d between the block member 15 and the outer end part of the effective bubble-generating region 16 is −3 μm, it is possible to enhance efficiency in ink ejection. Therefore, in the case where the block member 15 is arranged inside the effective bubble-generating region 16, the block member 15 is required to be arranged in the position where the distance d between the position of the inner end part and the outer end part of the effective bubble-generating region 16 is −3 μm or more.

As described above, in the present embodiment, by arranging the block member 15 in an appropriate position, it is possible to suppress a reduction in the pressure inside the bubble in the case where the pressure inside the bubble generated by driving the heat-generating element 12 is higher than the atmospheric pressure. In the present embodiment, the block member 15 is arranged in the position where the distance d between the position of the inner end part of the block member 15 and the outer end part of the effective bubble-generating region 16 is −3 μm or more and 2 μm or less, with the outward direction being set to be positive. Due to this, it is possible to enhance efficiency of ink ejection and to suppress the power consumption by the liquid ejection head to be low. Therefore, it is possible to suppress the running cost of the inkjet printing apparatus 1000 to be low. Furthermore, it is possible to lower the amount of heat generated by the heat-generating element 12, and thus it is possible to downsize the respective heat-generating elements 12 and to downsize the liquid ejection head 1. Moreover, because it is possible to downsize the liquid ejection head 1, it is possible to suppress the manufacturing cost of the liquid ejection head 1 to be low. Additionally, by limiting the amount of protrusion of the block member 15 from the heat-generating element 12 toward the ink ejection direction, it is possible to further downsize the liquid ejection head 1. Since the liquid ejection head 1 can be further downsized, it is possible to further suppress the manufacturing cost of the liquid ejection head 1 to be low.

Meanwhile, in FIG. 7, explanation has been given using the graph in the case where the block member 15 is arranged so that the distance from the effective bubble-generating region 16 is equal across the entire inner end part of the block member 15. However, the distance d between the inner end part of the block member 15 and the outer end part of the effective bubble-generating region 16 is not limited to the case where the distance d is equal across the entire inner end part of the block member 15. The distance d between the inner end part of the block member 15 and the outer end part of the effective bubble-generating region 16 may differ depending on the position. In such a case, it is desirable for the block member 15 to be arranged in the position where the distance d is +2 μm or less, with the outward direction being set to be positive, across the entire distance d that varies. Furthermore, it is desirable for the block member 15 to be arranged in the position where the distance d is −3 μm or more, with the outward direction being set to be positive, across the entire distance d that varies. That is, it is desirable for the block member 15 to be arranged in the position where the distance d, that varies, is −3 μm or more and +2 μm or less, with the outward direction being set to be positive, across the entire block member 15.

In each of the above-described embodiments, there has been explained the aspect of the liquid ejection head in which the flow passages extend in the two directions with respect to the heat-generating element 12, but the present invention is not limited to this. For example, the present invention can be applied also to the liquid ejection head of an aspect in which a flow passage extends in one direction with respect to the heat-generating element and the heat-generating element is surrounded by a flow passage wall in three directions. In the case of the liquid ejection head of such an aspect, it suffices that the block member has only to be formed in the entire region at least on the flow passage side with respect to the heat-generating element and that the block member has only to be partially formed on the side of the flow passage wall formed in the three directions. An aspect is preferable in which the block member surrounds the region of 62.5% or more of the periphery of the heat-generating element as a whole.

In addition, the liquid ejection head 1 is not limited to that applied to the aspect in which the liquid ejection head 1 is integrated with the ink tank as in the above-described embodiment. For example, there may be accepted a configuration in which the liquid ejection head and the ink tank are separated. In such a configuration, it is possible to exchange only the ink tank with a new one by attaching the new ink tank after detaching only the ink tank from the carriage in the case where the ink within the ink tank becomes empty. Therefore, the exchange of the ink tank together with the liquid ejection head is not necessarily needed, and thus it is possible to suppress the running cost of the inkjet printing apparatus to be low by reducing the frequency of exchange of the liquid ejection head.

Furthermore, the inkjet printing apparatus may have a system in which the liquid ejection head and the ink tank are arranged separately in different positions, and the liquid ejection head and the ink tank may be connected by a tube or the like. Ink may be supplied to the liquid ejection head through the tube or the like. Moreover, in the present embodiment, the inkjet printing apparatus is applied to the serial scan system in which the liquid ejection head scans along the main scanning direction A, but the present invention is not limited to this. The present invention is also applicable to an inkjet printing apparatus of full line type using the liquid ejection head extending across the range corresponding to the full width of a print medium.

In addition, in the present specification, "printing" is not only used in the case where significant information such as a character and a figure is formed, but also used regardless of whether information is significant or not. It is assumed that printing also means a case where an image, a design, a pattern, and the like, are formed widely on a print medium, or also a case where a print medium is subjected to processing, regardless of whether or not information is revealed so as to be visually recognized by a person.

Moreover, the "printing apparatus" includes an apparatus having a print function, such as a printer, a multifunctional printer, a copy machine, or a facsimile machine, and a manufacturing apparatus for manufacturing a product by using an inkjet technique.

Additionally, the "print medium" represents not only paper used in a general printing apparatus but also materials that can receive ink, widely such as cloth, plastic film, metal plate, glass, ceramics, wood material, and leather.

The "ink" (also referred to as "liquid" sometimes) should be construed widely in the same way as the definition of the above-described "printing". It is assumed that the ink represents a liquid that can be subjected to formation of an image, a design, a pattern, and the like, subjected to processing of a print medium, or subjected to processing of ink (for example, solidification or insolubilization of the coloring material in the ink applied onto a print medium), by being applied onto a print medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-097068, filed May 2, 2013, and No. 2014-080381, filed Apr. 9, 2014, which are hereby incorporated by reference herein in their entirety.

What is claimed is:

1. A liquid ejection head comprising:

a liquid chamber capable of storing liquid therein;

a heat-generating element capable of heating the liquid inside the liquid chamber; and an ejection port through which the liquid is ejected by generation of bubbles in a case of generating the bubbles within the liquid by heat generation of the heat-generating element in a state where the liquid is stored in the liquid chamber, wherein the liquid ejection head has a block member which surrounds at least a part of an effective bubble-generating region involved with heat generation in the heat-generating element and which is formed so as to protrude from a plane in which the heat-generating element is formed in a direction in which the liquid is ejected, and the block member is arranged in a position where a distance of a position of an inner end part of the block member from an outer end part of the effective bubble-generating region is +2 μm or less, with an outward direction being set to be positive.

2. The liquid ejection head according to claim 1, wherein the block member is formed in a position where the distance of the position of the inner end part of the block member from the outer end part of the effective bubble-generating region is −3 μm or more, with the outward direction being set to be positive.

3. The liquid ejection head according to claim 1, wherein an amount of protrusion of the block member protruding from the plane in which the heat-generating element is formed in the direction in which the liquid is ejected is 4 μm or less.

4. The liquid ejection head according to claim 1, wherein the block member is arranged so that the distance between the inner end part of the block member and the outer end part of the effective bubble-generating region is equal across the entire inner end part of the block member.

5. A liquid ejection head comprising:

a liquid chamber capable of storing a liquid therein;

a heat-generating element capable of heating the liquid inside the liquid chamber; and an ejection port through which the liquid is ejected by generation of bubbles in a case of generating the bubbles within the liquid by heat generation of the heat-generating element in a state where the liquid is stored in the liquid chamber, wherein the liquid ejection head has a block member which surrounds at least a part of an effective bubble-generating region involved with heat generation in the heat-generating element and which is formed so as to protrude from a plane in which the heat-generating element is formed in a direction in which the liquid is ejected, and the block member is arranged in a position where a period of time during which a pressure inside a bubble generated by driving the heat-generating element is higher than atmospheric pressure is lengthened in comparison with that in a case where the block member is not provided in driving the heat-generating element.

6. A liquid ejection head comprising:

a liquid chamber capable of storing the liquid therein;

a heat-generating element capable of heating the liquid inside the liquid chamber; and an ejection port through which the liquid is ejected by generation of bubbles in a case of generating the bubbles within the liquid by heat generation of the heat-generating element in a state where the liquid is stored in the liquid chamber, wherein the liquid ejection head has a block member which surrounds at least a part of an effective bubble-generating region involved with heat generation in the heat-generating element and which is formed so as to protrude from a plane in which the heat-generating element is formed in a direction in which the liquid is ejected, and the block member is arranged in a position where an amount of reduction per unit time in a pressure inside a bubble after driving the heat-generating element is reduced in comparison with that in a case where the block member is not provided.

7. An inkjet printing apparatus for performing printing by ejecting a liquid through an ejection port by using a liquid ejection head including:

a liquid chamber capable of storing a liquid therein;

a heat-generating element capable of heating the liquid inside the liquid chamber; and the ejection port through which the liquid is ejected by generation of bubbles in a case of generating the bubbles within the liquid by heat generation of the heat-generating element in a state where the liquid is stored in the liquid chamber, wherein a block member is provided, which surrounds at least a part of an effective bubble-generating region involved with heat generation in the heat-generating element and which is formed so as to protrude from a plane in which the heat-generating element is formed in a direction in which the liquid is ejected, and the block member is arranged in a position where a distance of a position of an inner end part of the block member from an outer end part of the effective bubble-generating region is +2 μm or less, with an outward direction being set to be positive.

8. A liquid ejection head comprising:

an ejection port through which a liquid is ejected; and a substrate on which a heat-generating element generating energy used for ejecting the liquid is formed, wherein on the substrate, a convex portion is formed around the outer circumference of an effective bubble-generating region of the heat-generating element and an interval between the effective bubble-generating region of the heat-generating element and the convex portion is 2 μm or less.

9. The liquid ejection head according to claim 8, wherein the convex portion is formed discontinuously.

10. The liquid ejection head according to claim 8, wherein the height of the convex portion from the surface of the substrate is 4 μm or less.

11. A liquid ejection head comprising:

an ejection port through which a liquid is ejected; and a substrate on which a heat-generating element generating energy used for ejecting the liquid is formed, wherein on the substrate, a convex portion surrounding a centroid of the heat-generating element is formed on an effective bubble-generating region of the heat-generating element and an interval between an outer end part of the effective bubble-generating region of the heat-generating element and the convex portion is 3 μm or less.

12. The liquid ejection head according to claim 11, wherein the convex portion is formed discontinuously.

13. The liquid ejection head according to claim 11, wherein the height of the convex portion from the surface of the substrate is 4 μm or less.

* * * * *